US007318466B2

(12) United States Patent
Biramben et al.

(10) Patent No.: US 7,318,466 B2
(45) **Date of Patent: *Jan. 15, 2008**

(54) LOST WAX CASTING METHOD

(75) Inventors: Arnaud Biramben, Paris (FR); Patrick Calero, Menucourt (FR); Patrick Chevalier, Sannois (FR); Jean-Christophe Husson, Les Ulis (FR); Christian Marty, Boulogne (FR); Patrice Ragot, Bessancourt (FR); Jean-Pierre Richard, Taverny (FR); Franck Truelle, Argenteuil (FR); Isabelle Valente, Suresnes (FR)

(73) Assignee: SNECMA Moteurs, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/127,092

(22) Filed: May 12, 2005

(65) Prior Publication Data

US 2005/0252634 A1 Nov. 17, 2005

(30) Foreign Application Priority Data

May 12, 2004 (FR) ..... 04 05143

(51) Int. Cl.
*B22C 1/00* (2006.01)
*B22C 9/04* (2006.01)

(52) U.S. Cl. ..... 164/35; 164/519

(58) Field of Classification Search ..... 164/34–36, 164/516–519

See application file for complete search history.

(56) References Cited

U.S. PATENT DOCUMENTS

| | | | | |
|---|---|---|---|---|
| 3,859,153 | A | 1/1975 | Beyer et al. | |
| 5,618,633 | A | 4/1997 | Swanson et al. | |
| 5,766,329 | A * | 6/1998 | LaSalle et al. | 106/38.9 |
| 6,431,255 | B1 * | 8/2002 | Ghosh et al. | 164/361 |

FOREIGN PATENT DOCUMENTS

| | | | |
|---|---|---|---|
| EP | 0 399 727 A1 | | 11/1990 |
| WO | WO 98/32557 | * | 7/1998 |
| WO | WO 01/45876 A1 | | 6/2001 |

OTHER PUBLICATIONS

U.S. Appl. No. 11/125,084, filed May 10, 2005, Biramben et al.
U.S. Appl. No. 11/127,092, filed May 12, 2005, Biramben et al.

* cited by examiner

*Primary Examiner*—Kuang Y. Lin
(74) *Attorney, Agent, or Firm*—Oblon, Spivak, McClelland, Maier & Neustadt, P.C.

(57) ABSTRACT

A method of manufacture of a multilayer ceramic shell mould out of a master pattern includes the steps of dipping the master pattern in a first slip containing ceramic particles and a binder, depositing sand particles to form a contact layer, dipping the master pattern in a second slip containing ceramic particles and a binder, depositing sand particles to form an intermediate layer, dipping the master pattern in at least a third slip containing ceramic particles to form a reinforcing layer. The ceramic particles of the slips includes mullite, alumina, or a mixture of the two, whereas no layer contains any zircon.

16 Claims, No Drawings

LOST WAX CASTING METHOD

BACKGROUND OF THE INVENTION

1. Field of the Invention

The present invention relates to the manufacture of parts such as complex geometry metals vanes and shrouds according to the technique known as lost wax casting.

2. Discussion of the Background

For the manufacture of vanes and shrouds for turbojet engines, such as rotor or stator parts, or structural parts according to this technique, a master pattern is prepared first of all, using wax or any other similar material easily disposable at a later stage. If necessary, several master patterns are gathered into a cluster. A ceramic mould is prepared around this master pattern by dipping in a first slip to form a first layer of material in contact with the surface thereof. The surface of said layer is reinforced by sanding, for easier bonding of the following layer, and the whole is dried: composing respectively the stuccowork and drying operations. The dipping operation is then repeated in slips of possibly different compositions, an operation always associated with the successive stuccowork and drying operations. A ceramic shell formed of a plurality of layers is then provided. The slips are composed of particles of ceramic materials, notably flour, such as alumina, mullite, zircon or other, with a colloïdal mineral binder and admixtures, if necessary, according to the rheology requested. These admixtures enable to control and to stabilise the characteristics of the different types of layers, while breaking free from the different physical-chemical characteristics of the raw materials forming the slips. They may be a wetting agent, a liquefier or a texturing agent relative, for the latter, to the thickness requested for the deposit.

The shell mould is then dewaxed, which is an operation thereby the material forming the original master pattern is disposed of. After disposing of the master pattern, a ceramic mould is obtained whereof the cavity reproduces all the details of the master pattern. The mould is then subjected to high temperature thermal treatment or "baked", which confers the necessary mechanical properties thereto.

The shell mould is thus ready for the manufacture of the metal part by casting. After checking the shell mould for internal and external integrity, the following stage consists in casting a molten metal into the cavity of the mould, then in solidifying said metal therein. In the field of lost wax casting, several solidification techniques are currently distinguished, hence several casting techniques, according to the nature of the alloy and to the expected properties of the part resulting from the casting operation. It may be a columnar structure oriented solidification (DS), a monocrystalline structure oriented solidification (SX) or an equiaxed solidification (EX) respectively. Both first families of parts relate to superalloys for parts subjected to high loads, thermal as well as mechanical in the turbojet engine, such as HP turbine vanes.

After casting the alloy, the shell is broken by a shaking-out operation, and the manufacture of the metal part is finished.

During the moulding stage, several types of shells may be used via several methods. Each shell should possess specific properties enabling the type of solidification desired. For example, for equiaxed solidification, several different methods may be implemented the one using an ethyl silicate binder, another using a colloïdal silica binder. For oriented solidification, the shells may be realised out of different batches, silica-alumina, silica-zircon or silica based batches.

SUMMARY OF THE INVENTION

For simplification and standardisation of the methods implemented, there is a need for a so-called 'single' structure shell, whereof the properties would enable usage in the different cases of solidification.

On the other hand, to comply with environmental and cost standards, there is also a need to dispense with the use of alcohol-based binders such as ethyl silicate.

By reasons of waste-associated costs, it is also desirable to develop a shell structure not comprising any zircon. Such material, even little radio-active, involves establishing waste handling procedures which are highly demanding, industrially as well as financially.

The invention meets these objectives with the following method.

The method of manufacture of a multilayer ceramic shell mould whereof at least one contact layer, one intermediate layer and several reinforcing layers, out of a wax master pattern or other similar material, consists in performing the following operations:

- dipping in a first slip containing ceramic particles and a binder, depositing sand particles on the layer and drying said layer, so as to form the contact layer,
- dipping in a second slip containing ceramic particles, a binder, depositing sand particles on the layer and drying said layer, so as to form the intermediate layer,
- dipping in at least a third slip containing ceramic particles, a binder, depositing sand particles on the layer and drying said layer, so as to form a reinforcing layer. The formation of reinforcing layers is repeated until obtaining a shell mould of set thickness.

According to the invention, the method characterised in that the ceramic particles of the slips comprise a refractory oxide or a mixture of zircon-less refractory oxides, whereas no layer contains any zircon.

Preferably, the slip for the formation of the reinforcing layers is much more fluid than the second slip.

DETAILED DESCRIPTION OF THE PREFERRED EMBODIMENTS

It has been noticed that a shell mould exhibiting such composition and such structure, with the difference of the contact layer, might be designed to be common to all the types of castings according to the techniques mentioned above. The mechanical properties of the mould may thus be advantageously adjusted, in particular, its sensitivity to thermal shocks, to comply with the casting conditions meeting the stresses of the various solidification methods (EX, DS or SX).

Preferably and to comply with the economic and environmental requirements, the binder for the various slips is a mineral colloïdal solution such as colloïdal silica. Similarly, to comply with the economic requirements associated with waste, the stucco grains for the contact, intermediate and reinforcing layers are composed of mullite grains and not zircon.

To control the porosity of the mould, and consequently to control the sensitivity of the shell to thermal shocks, the stuccowork operations are performed with stucco grains covering a granulometric range comprised between 80 and 1000 microns. Besides, the stucco is applied preferably by sprinkling for the first layers, and is applied preferably by fluidised bed, for the layers as of the fourth. The stucco is applied automatically, so that the movements of the robot enable to realise a shell mould exhibiting an after-baking porosity, ranging between 20 and 35%. The more porous the shell, the more its sensitivity to thermal shocks is reduced, such as those produced during the different types of casting operations.

In particular, to be applicable to two distinct solidification modes, the baking cycle of the mould consists in heating up to a temperature ranging between 1000 and 1150° C., preferably between 1030 and 1070° C.

It suffices to adapt the contact layer to the solidification mode. Thus, the first slip may be formed out of mullite flours and zircon-less alumina, with or without germinative.

In a particular case, for DS or SX type solidifications, the contact layer is composed mostly of mullite flour in an amount ranging from 40 and 80% in weight, possibly alumina flour, a colloïdal silica-based binder, and organic admixtures.

In the particular case of equiaxed solidification, the contact layer is composed of a mixture of alumina and mullite flours in amounts ranging respectively between 40 and 80% in weight for alumina and between 2 and 30% in weight for the mullite flour, the remainder comprising a colloïdal silica-based binder, a germinative, and organic admixtures.

According to another characteristic, the second and third slips are common to any solidification method are common to any solidification method, and comprise a mixture of alumina and mullite flours in amounts ranging between 45 and 95% en weight, and mullite grains in amounts ranging between 0 and 25% en weight.

The mould structure thus defined finds, indifferently, a usage

- for the manufacture of a part with columnar structure oriented solidification, the contact layer being formed mostly of a mullite flour,
- for the manufacture of a part with mono-crystalline structure oriented solidification, the contact layer being formed mostly out of a mullite flour or
- for the manufacture of a part with equiaxed solidification, the contact layer being formed out of a mixture of alumina and mullite flours.

The invention also refers to a method of manufacture of parts by casting molten metal wherein, regardless of the solidification type, columnar structure oriented, monocrystalline structure oriented or equiaxed, the moulds used exhibit a common skeleton of shells: common intermediate layer and reinforcing layer.

The invention also refers to an installation for the manufacture of parts by casting molten metal, in a shell mould comprising a mould manufacturing station and casting stations for different solidifications, said stations being supplied with moulds exhibiting identical reinforcing layers.

The method is described more in detail thereunder.

The method of manufacturing shell moulds enabling usage common to all types of parts comprises a first stage consisting in making the master pattern out of wax or another similar material known in the art. The most generally known is wax. According to the type of part, the master patterns may be grouped in clusters in order to manufacture several of them simultaneously. The master patterns are shaped to the sizes of the finished parts, allowing for the contraction of alloys.

The manufacturing stages of the shell are preferably carried out by a robot whereof the movements are common to all types of parts, programmed for optimal action on the quality of the deposits realised, and for breaking free from the geometric aspect of the different vanes and shrouds.

Slips are prepared in parallel wherein the master patterns or the cluster are dipped in succession to deposit the ceramic materials.

A first slip is distinguished for EQX solidification.

It comprises in weight percentage:

- a mixture of alumina (40-80%) and mullite (2-30%) flours;
- a germinative, cobalt aluminate (0-10%);
- a colloïdal silica binder (18-30%);
- water (0-5%);
- three admixtures: wetting agent, liquefier and texturing agent;

For columnar or monocrystalline structure oriented solidification, the composition of the first slip in weight percentage is as follows:

- a mixture of alumina (2-30%) and mullite (40-80%) flours;
- a colloïdal silica binder (18-30%);
- water (0-5%);
- three admixtures: wetting agent, liquefier and texturing agent;

The second intermediate slip, common to all types of solidification, comprises in weight percentage the following components:

- a mixture of alumina (50-75%) and mullite (5-20%) flours;
- a colloïdal silica binder (20-30%);
- water (0-5%);
- three admixtures: wetting agent, liquefier and texturing agent;

The third reinforcing slip, common to all types of solidification, comprises in weight percentage:

- a mixture of alumina (30-45%) and mullite (15-30%) flours;
- mullite grains (14-24%);
- a colloïdal silica binder (10-20%);
- water (5-15%);
- four admixtures: wetting agent, liquefier, texturing agent and sintering agent;

The first 3 admixtures fulfil the following functions, respectively:

- The liquefier enables to obtain more rapidly the rheology required during the manufacture of the layer. It acts as a dispersing agent. It may belong to the family of amino acids, to the range of ammonium polyacrylates, or to the family of carboxylic tri-acids with alcohol groups;
- The wetting agent facilitates the coating of the layer during the dipping process. It may belong to the family of poly-alkylene fat alcohols or alkoxylate alcohols;
- The texturing agent enables to optimise the layer for obtaining suitable deposits. It may belong to the family of ethylene oxide polymers, xanthan gums, or guar gums;

For the contact layer no 1, once the master pattern withdrawn from the first slip after an immersion phase, the master pattern thus covered is subjected to dripping, then coating. Then, "stucco" grains are applied, by sprinkling so as not to disturb the thin contact layer. For the stuccowork operation, mullite is used whereof the size distribution in this first layer is thin. It ranges from 80 to 250 microns. The surface condition of the finished parts depends partially thereof.

The layer no 1 is dried.

A dipping phase is then performed in a second slip to form a so-called "intermediate" layer no 2. The composition is the same regardless of the solidification mode adopted.

As previously, "stucco" is deposited by sprinkling, before drying. For the stuccowork operation, mullite is used, whereof the size distribution is medium. It may range from 120 to 1000 microns. The porosity surface of the finished shells depends partially thereof.

The master pattern is then dipped in a third slip to form the layer 3 which is the first so-called reinforcing layer.

The stucco identical to layer no 2 is then applied by sprinkling, before drying. The dipping, stucco application and drying operations are repeated in the third slip to form the so-called "reinforcing" layers. For said reinforcing layers, the stucco application is conducted by fluidised bed.

For the last layer, a glazing operation is performed, not containing, the stucco application.

The final shell may be composed of 5 to 12 layers.

The dipping operations for the different layers are conducted differently and adapted for obtaining homogeneous distribution of the thicknesses and preventing the formation of bubbles, in particular in trapped zones.

The dipping programs are optimised for every type of layer, in order to dispense with the geometric aspect of the different types of parts, and are therefore common to all references.

The interlayer drying range is optimised for every type of layer, in order to dispense with the geometric aspect of the different types of parts. The range is therefore common. The range enables indeed for every type of layer, drying moulds with geometries as different as mobile vanes, distributors or structural parts.

The last layer formed is finally dried common to all types of parts.

The baking cycle of the moulds is the same for all the types of solidification, and dispenses with therefore the type of part, consequently. It comprises a temperature rise phase, a soak time at baking temperature and a cool-down phase. The baking cycle is selected to optimise the mechanical properties of the shells so as to enable cold handling without any risk of breakage and to minimise their sensitivities to thermal shocks which might be generated during the various casting phases.

It is noticed that a single baking cycle may be realised instead of both baking types which were conducted in the past, to prepare the EQX, DS and SX shells, in different casting moulds.

The invention claimed is:

1. A method of manufacturing a multilayer ceramic shell mould with at least one contact layer, one intermediate layer and several reinforcing layers, out of a master pattern, said method comprising the following steps:

dipping said master pattern in a first slip containing ceramic particles and a binder to form a first layer, depositing sand particles onto the first layer and drying said first layer, in order to form said contact layer, dipping said master pattern in a second slip containing ceramic particles and a binder to form a second layer, depositing sand particles onto said second layer and drying said second layer, in order to form said intermediate layer, dipping said master pattern in at least a third slip containing ceramic particles and a binder to form a third layer, depositing sand particles onto said third layer, drying said third layer, in order to form a reinforcing layer, forming reinforcing layers being repeated until obtaining a shell mould of a set thickness, and baking the shell mould by heating up the shell mould to a temperature ranging between 1000 and 1150° C., wherein the ceramic particles of the slips comprise mullite or alumina, or a mixture of mullite and alumina, whereas no layer contains any zircon, and wherein said second slip comprises in weight percentage:

a 50-75% mixture of alumina flour, a 5-20% mullite flour, a 20-30% colloïdal silica binder, 0-5% water, and a wetting agent, a liquefier and a texturing agent, wherein said sand particles are composed of mullite grains, wherein the sand particles are applied so that the shell mould exhibits an after-baking porosity ranging between 20 and 35%, and wherein the second and third slips comprise a mixture of alumina and mullite flours and mullite grains.

2. The method according to claim 1, wherein the particles of the slips comprise one of mullite or alumina.

3. The method according to claim 1, wherein the binders for the different slips are based on mineral colloïdal solutions.

4. The method according to claim 1, wherein the grains have a size distribution ranging between 80 and 1000 microns.

5. The method according to claim 1, wherein for the first three layers, the sand particles are applied by sprinkling.

6. The method according to claim 1, wherein the sand particles are applied by fluidised bed.

7. The method according to claim 1, wherein the first slip for oriented solidification contains mullite flour, in an amount ranging from 40 and 80% in weight, alumina flour, a colloïdal silica-based binder, and organic admixtures.

8. The method according to claim 1, wherein the first slip for equiaxed solidification, comprises a mixture of alumina and mullite flours in amounts ranging respectively between 40 and 80% in weight of alumina and between 2 and 30% in weight of mullite flow, a colloïdal silica-based binder, a germinative and organic admixtures.

9. The method according to claim 1, wherein the second and third slips comprise a mixture of alumina and mullite flours in amounts ranging between 45 and 95% in weight, and mullite grains in amounts ranging between 0 and 25% in weight.

10. The method according to claim 1, further comprising a baking cycle of the finished shell mould, wherein the baking cycle comprises heating up to a temperature ranging between 1030 and 1170° C.

11. The method according to claim 1, wherein said third slip comprises in weight percentage:

a 30-45% mixture of alumina flour, a 15-30% mullite flour, 14-24% mullite grains, a 10-20% colloidal silica binder, 5-15% water, and a wetting agent, a liquefier, a texturing agent and a sintering agent.

12. The method according to claim 11, wherein said first slip comprises in weight percentage:

a 40-80% mixture of alumina flour, a 2-30% mullite flour, a 0-10% germinative, cobalt aluminate, a 18-30% colloidal silica binder, 0-5% water, and a wetting agent, a liquefier and a texturing agent.

13. The method according to claim 11, wherein said first slip comprises in weight percentage:

a 2-30% mixture of alumina flour, a 40-80% mullite flour, a 18-30% colloïdal silica binder, 0-5% water, and a wetting agent, a liquefier and a texturing agent.

14. The method according to claim 1, wherein said depositing of said sand particles is performed so as to control said after-baking porosity thereby controlling the shell mould's sensitivity to thermal shock to comply with casting conditions meeting stresses of a solidification method selected from the group consisting of an equiaxed solidification (EX), a columnar structure oriented solidification (DS) and a mono-crystalline structure oriented solidification (SX).

15. The method according to claim 1, wherein the step of baking the shell mould consists of heating up the shell mould to a temperature ranging between 1000 and 1150° C. such that said method is free of any heating of said shell mould to a temperature greater than 1150° C.

16. The method according to claim 1, wherein said method is free of a step of including a ceramic based mat of reinforcing material in said shell mould.

* * * * *